United States Patent [19]

Heidemann

[11] 4,057,012

[45] Nov. 8, 1977

[54] PRINTING PRESS CONVERTIBLE FROM INTAGLIO TO FLEXOGRAPHIC PRINTING AND VICE VERSA

[75] Inventor: Rolf Heidemann, Ibbenburen, Germany

[73] Assignee: Windmoller & Holscher; Lengerich, Germany

[21] Appl. No.: 775,953

[22] Filed: Mar. 9, 1977

[30] Foreign Application Priority Data

Mar. 10, 1976 Germany ..... 2610028

[51] Int. Cl.[2] ..... B41F 9/00; B41F 11/00

[52] U.S. Cl. ..... 101/153; 101/219; 101/247

[58] Field of Search ..... 101/152, 153, 154–157, 101/178–182, 219, 225, 228, 247, 349–351

[56] References Cited

U.S. PATENT DOCUMENTS

| | | | |
|---|---|---|---|
| 2,164,270 | 6/1939 | George | 101/153 |
| 2,676,537 | 4/1954 | Kanitz | 101/153 |
| 2,716,942 | 9/1955 | Timson et al. | 101/153 X |
| 3,288,060 | 11/1966 | Miller | 101/153 |
| 3,793,952 | 2/1974 | Neumann et al. | 101/157 |
| 3,889,596 | 6/1975 | Thomas et al. | 101/154 |

*Primary Examiner*—J. Reed Fisher
*Attorney, Agent, or Firm*—Fleit & Jacobson

[57] ABSTRACT

A printing press convertible from intaglio to flexographic (letterpress) printing comprises a rubber impression cylinder and a steel impression cylinder which are selectively applied to an appropriate plate cylinder. The steel cylinder is carried by a displaceable carriage and the rubber cylinder can be swung from an operative position interposed between the steel and plate cylinders to an inoperative position above the steel cylinder by being carried by pivotable arms. A guide roller, over which the web to be printed is passed towards the plate cylinder is displaceable from a position directly above the steel cylinder during flexographic printing to a position above and at one side of the steel cylinder during intaglio printing.

6 Claims, 3 Drawing Figures

PRINTING PRESS CONVERTIBLE FROM INTAGLIO TO FLEXOGRAPHIC PRINTING AND VICE VERSA

The invention relates to a printing press convertible from intaglio to flexographic printing and vice versa, comprising two impression cylinders which are mounted in displaceable and securable mountings and which consist of a rubber cylinder and a steel cylinder for selective application to plate cylinders that are exchangeable for intaglio and flexographic printing, and guide rollers disposed above the impression cylinders.

In a press of this kind from DT-AS 2,139,834 (Federal Republic of Germany), the impression cylinders are rotatably mounted in a turret that is displaceable in guides of the frame of the press relatively to the axis of the plate cylinder. When the press is being operated for intaglio printing, the web is satisfactorily conveyed in registry with the lay mark between the intaglio plate cylinder and the impression cylinder which has an elastic surface. During operation as a flexographic printing press, the web is led between the stereotype cylinder and the steel cylinder serving as the impression cylinder, the cylinder with the elastic surface having been replaced by the steel cylinder by turning the turret. The web tension can be interrupted or become defective during flexographic printing at those places where the stereotype contains little or no type because in those positions there is no pressure or inadequate pressure between the stereotype cylinder and the steel cylinder. To avoid this defect, feed rollers are often applied to the steel cylinder so that the web is pressed to the driven steel cylinder by the feed roller, it being intended that this should ensure its uniform feeding. However, it has been found that despite such feed rollers there can still be lay mark errors during passage of the web.

It is therefore an object of the invention to improve or ensure accurate transport by appropriate guiding of the web in printing presses convertible from intaglio to flexographic printing and vice versa.

According to the invention, this object is achieved in a printing press of the aforementioned kind in that the steel cylinder is mounted in a displaceable carriage and the rubber cylinder, which can be swung from its position between the steel and plate cylinders to a position above the steel cylinder between the web deflected by the steel cylinder, is pivoted to pivotable arms, and that the mountings of the guide roller supplying the web to be printed are displaceable from a position at which they do not cover the rubber cylinder in plan view during intaglio printing to a position above the steel cylinder during flexographic printing. In the printing press according to the invention, therefore, one web guide roller over which the web to be printed during intaglio operation is fed to the rubber cylinder acting as the impression cylinder is mounted for displacement and, upon conversion to flexographic printing, is displaced to a position approximately vertically above the steel cylinder so that the web running onto the steel cylinder lies substantially parallel to that running off the cylinder, the rubber cylinder being swung so that it is disposed in the space between the web runs onto and off the cylinder. By guiding the web in accordance with the invention, the web envelops the steel cylinder through a large angle during flexographic printing, so that the slip between the web and the cylinder is substantially avoided. This ensures accurate transport in accordance with the lay mark.

Preferred embodiments of the invention are described in more detail in the subsidiary claims.

An example of the invention will now be described in more detail with reference to the drawing, in which.

Figure 1:
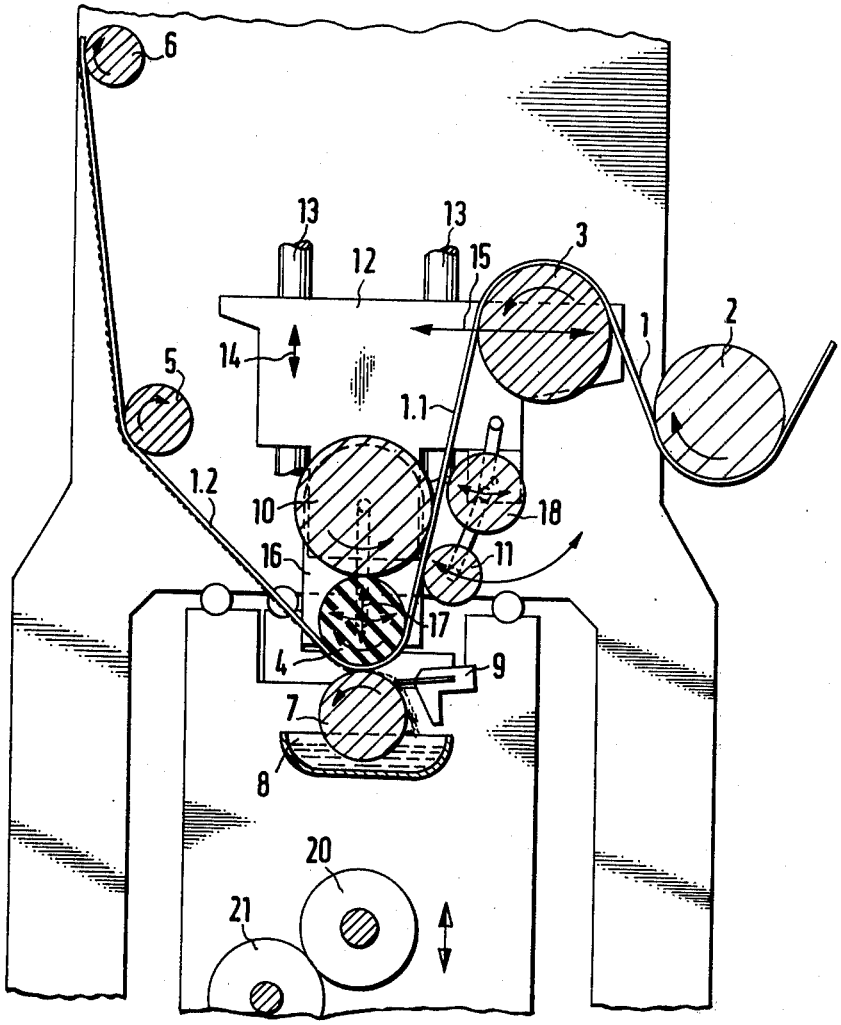
FIG. 1 is a diagrammatic side elevation of the printing press set up for intaglio printing.

A web 1 is fed to drying equipment (not shown) by way of guide rollers 2, 3, a rubber cylinder 4 and guide rollers 5, 6 which are rotatable in the frame of the press. Applied to the rubber cylinder 4 there is an intaglio plate cylinder 7 which dips into an ink trough 8 and is doctored by a doctor 9. The rubber cylinder 4 is supported against bending by a steel cylinder 10. To balance out engraving differences in the plate cylinder 7, there may be applied to the web 1 an adjusting roller 11 which is pivotable in known manner to a position that is not parallel to the cylinders 4, 7 and 10.

The guide roller 2 is rotatably mounted in the frame of the press and the guide roller 3 as well as the steel cylinder 10 are rotatable in guide carriages 12 which are provided at both ends of the steel cylinder and which can be displaced in a vertical direction in accordance with the double arrow 14 along guide rods 13 which are fixed with respect to the frame. The mounting 3.1 of the guide roller 3 can be displaced horizontally in accordance with the double arrow 15 along guide and conveying rods 15.1. With a course for the web set for intaglio printing, the web 1 must not touch the steel cylinder 10 because the surface of the latter moves in the opposite direction to the web 1. The rubber cylinder 4 is rotatable in a swing arm 16 which can be swung about an axis that is coincident with the rotary axis of the steel cylinder 10. The bearings of the rubber cylinder 4 are displaceable in the swing arm 16 according to the arrow 17 so that, even after its surface has been worn, it can again be brought into intimate contact with the steel cylinder.

Figure 2:
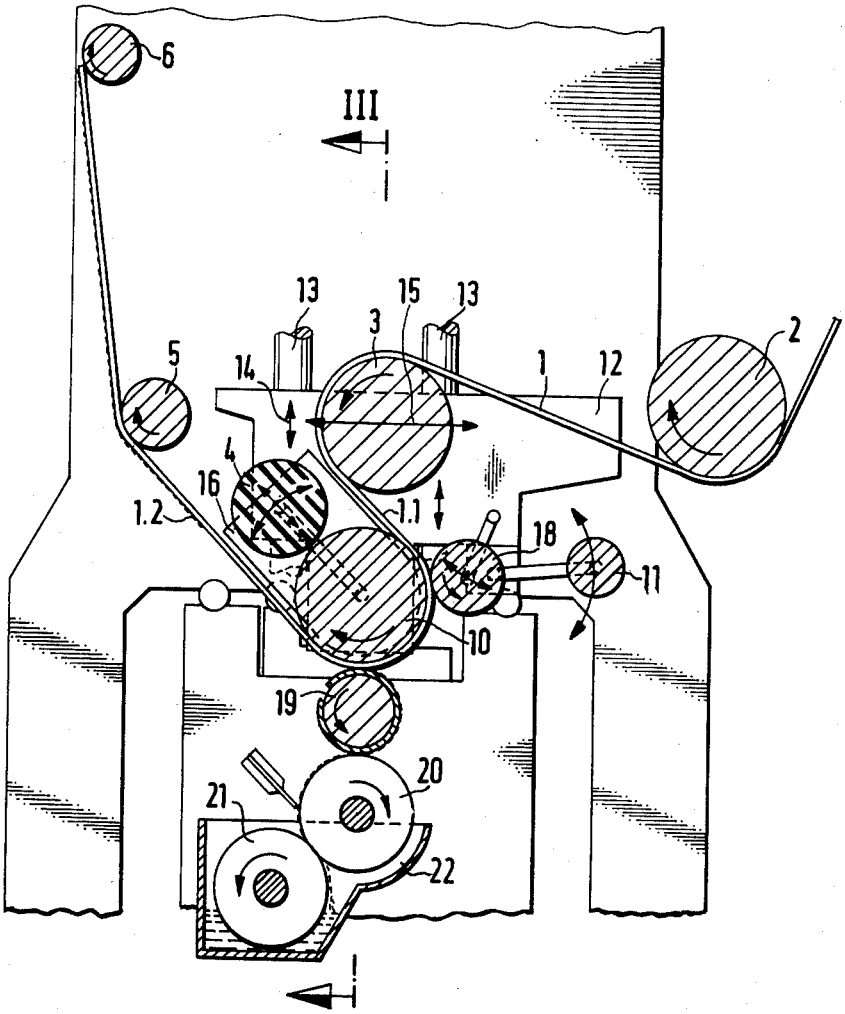
FIG. 2 is a side elevation of the press set up for flexographic printing.
Figure 3:
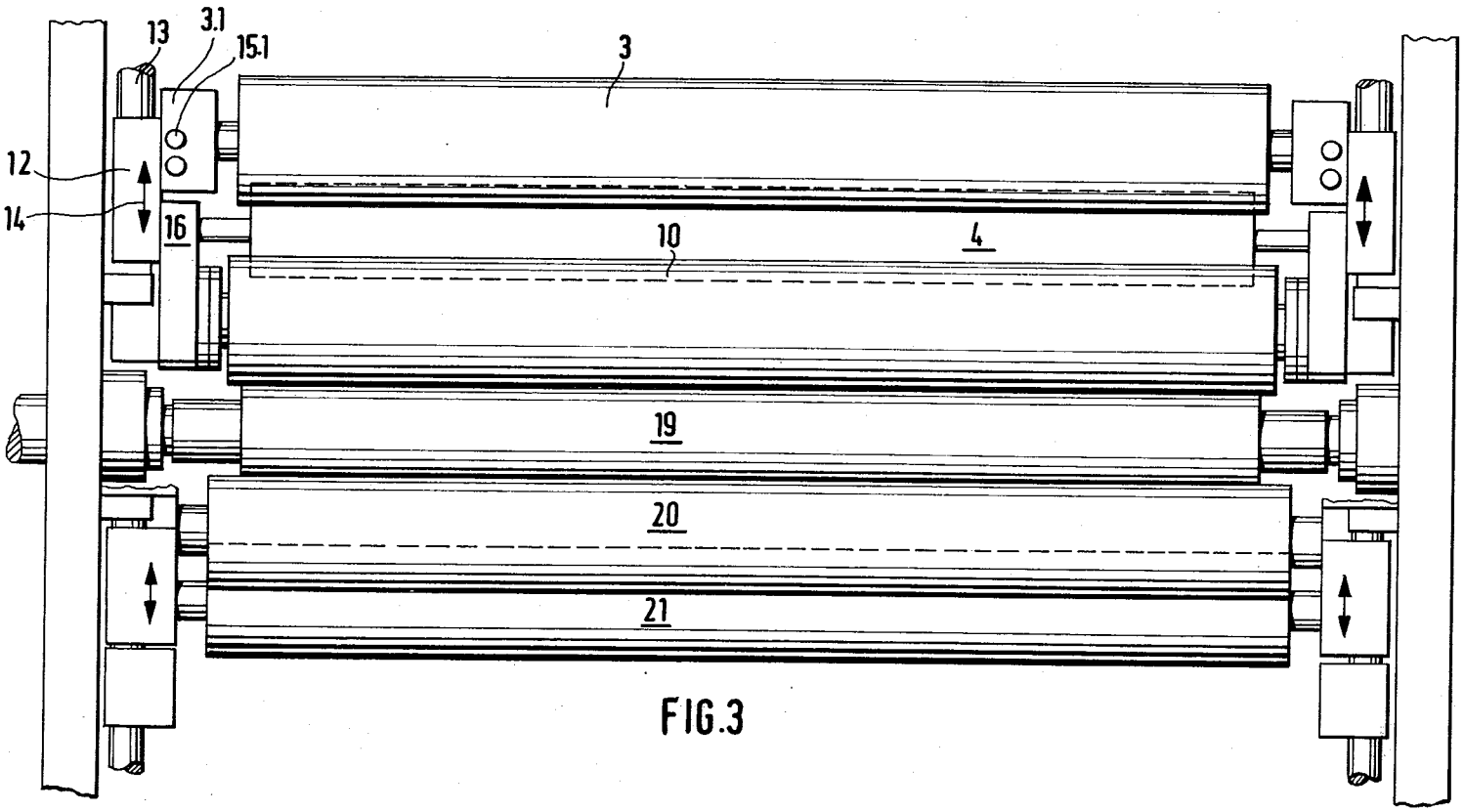
FIG. 3 is a section on the line III—III in FIG. 2.

In FIG. 2, the press is shown in a condition converted to flexographic printing. The rubber cylinder 4 is swung away from the web 1 by turning the swing arm 16 and the guide roller 3 is displaced to the left so that it lies roughly above the steel cylinder 10 which, in contrast with operation for intaglio printing, is now driven by coupling to the main drive, and the runs 1.1 and 1.2 of the web running onto and off the steel cylinder 10 are substantially parallel to one another. In the space between the two runs 1.1 and 1.2 of the web there is disposed the swung-away rubber cylinder 4 which has a smaller diameter than the steel cylinder 10. Swung onto the steel cylinder 10 there is a feed roller 18 which is pivotably mounted in guide carriages 12 and presses the web 1 onto the steel cylinder 10 over which it is passed. The feed roller 18 is not required for intaglio printing because in that case feeding takes place by way of the plate cylinder 7 co-operating with the rubber cylinder 4.

By reason of the intimate enveloping of the steel cylinder 10 by the web 1 over an angle of about 180°, slip is avoided between the web and the cylinder. This effect is enhanced by the application of the feed roller 18. For flexographic printing, the press is also converted at the side of the printing mechanism. The plate cylinder 7 is replaced by a stereotype cylinder 19. A screen roller 20 and an immersion roller 21 with an ink trough 22 are raised from a waiting position at a lower level and the screen roller 20 is brought into contact with the stereotype cylinder 19. By displacement in the direction of the double arrow 14, the steel cylinder 10 comes into contact with the stereotype cylinder 19.

The path through which the guide roller 3 is moved to the left and, during conversion from flexographic to intaglio printing, to the right, can be such that the lengths of web between the guide rollers 2 and 5 are equal for both printing operations, thereby making any further conversion unnecessary. Any slight differences that may still occur are balanced out by a known jockey roller (not shown) over which the web 1 passes and which is disposed upstream of the guide roller 2.

I claim:

1. A web printing press convertible from intaglio to flexographic printing and vice versa, comprising a frame; means for selectively mounting a flexographic printing cylinder and an intaglio printing cylinder within said frame; two impression cylinders; means for mounting said impression cylinders in displaceable and securable mountings on said frame; said impression cylinders including a rubber cylinder and a steel cylinder for selective cooperation with said intaglio printing cylinder and said flexographic printing cylinder, respectively; guide rollers disposed above said impression cylinders for guiding the web to be printed through upstream and downstream paths relative to the printing nip; said mounting means including means for mounting said steel cylinder in a displaceable carriage and further including means for mounting said rubber cylinder on pivotable arms for swinging said rubber cylinder about a pivotal axis from a position between said steel cylinder and said intaglio printing cylinder to a position above said steel cylinder and between said upstream and downstream web paths; means for mounting one of said web guide rollers for displacement from a vertical position above the said steel cylinder during flexographic printing to a position offset therefrom during intaglio printing.

2. A printing press according to claim 1, wherein said pivotable arms are mounted for pivotable motion about the axis of said steel cylinder.

3. A printing press according to claim 1 including bearings for supporting the said rubber cylinder on said pivotal arms and means for adjusting the spacing of said bearings from the said pivotal axis.

4. A printing press according to claim 1 wherein the said steel cylinder supports the rubber cylinder during intaglio printing.

5. A printing press according to claim 1 further including means for mounting a web feed roller for cooperation with said steel cylinder after conversion to flexographic printing.

6. A printing press according to claim 1 wherein said displaceable web guide roller is displaceable horizontally relative to said displaceable carriage that is arranged for vertical displacement.

* * * * *